US009132635B2

(12) United States Patent
Iwano et al.

(10) Patent No.: US 9,132,635 B2
(45) Date of Patent: Sep. 15, 2015

(54) LIQUID DISCHARGING HEAD

(71) Applicant: CANON KABUSHIKI KAISHA, Tokyo (JP)

(72) Inventors: Takuya Iwano, Inagi (JP); Chiaki Muraoka, Kawaguchi (JP); Yukuo Yamaguchi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 1 day.

(21) Appl. No.: 14/139,453

(22) Filed: Dec. 23, 2013

(65) Prior Publication Data

US 2014/0184701 A1 Jul. 3, 2014

(30) Foreign Application Priority Data

Dec. 27, 2012 (JP) ..... 2012-285433

(51) Int. Cl.
*B41J 2/05* (2006.01)
*B41J 2/14* (2006.01)

(52) U.S. Cl.
CPC ..... *B41J 2/1404* (2013.01); *B41J 2/14016* (2013.01); *B41J 2/1433* (2013.01); *B41J 2002/14475* (2013.01); *B41J 2202/07* (2013.01)

(58) Field of Classification Search
CPC ..... B41J 2/14; B41J 2/14016; B41J 2/14032; B41J 2/1404; B41J 2/1433
USPC ..... 347/47, 61, 63, 92, 44, 65
See application file for complete search history.

(56) References Cited

U.S. PATENT DOCUMENTS

| | | | | |
|---|---|---|---|---|
| 6,520,626 | B1 * | 2/2003 | Murakami | 347/56 |
| 2007/0058010 | A1 * | 3/2007 | Nagashima | 347/85 |
| 2007/0146437 | A1 * | 6/2007 | Murakami et al. | 347/61 |

FOREIGN PATENT DOCUMENTS

JP 2008-238401 A 10/2008

* cited by examiner

*Primary Examiner* — Henok Legesse
(74) *Attorney, Agent, or Firm* — Canon USA Inc IP Division

(57) ABSTRACT

A liquid discharging head is configured including an element substrate and a flow path forming substrate which are joined. The element substrate includes a plurality of energy generating elements (electrothermal conversion elements) configured to generate thermal energy, and a supply port configured to supply liquid. The flow path forming substrate includes a plurality of discharging ports, a bubble generating chamber formed so as to include an energy generating element, and a supply path which connects the bubble generating chamber and the supply port. The upstream side of the discharging port in the direction of liquid flowing from the supply path to the bubble generating chamber, as viewed from a planar view, is formed in a semicircular shape, and the downstream side is formed in a semi-polygonal shape.

6 Claims, 7 Drawing Sheets

FIG. 5A1
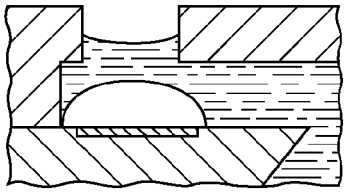
FIG. 5A2
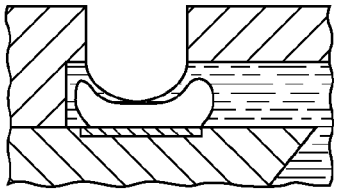
FIG. 5A3
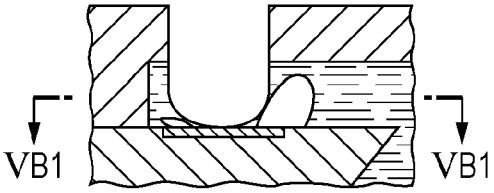
FIG. 5A4
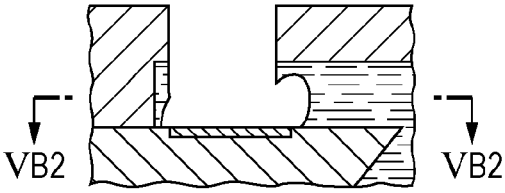
FIG. 5B1
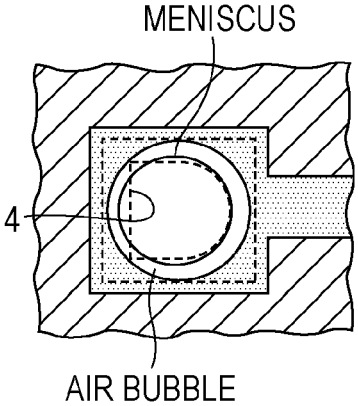
FIG. 5B2
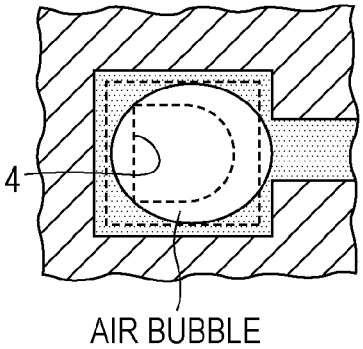

FIG. 6A1
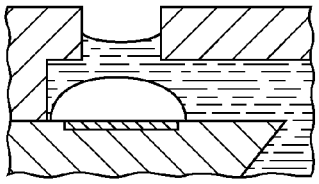
FIG. 6A2
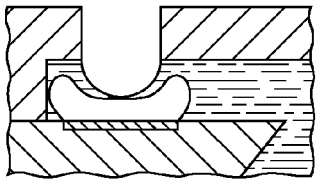
FIG. 6A3
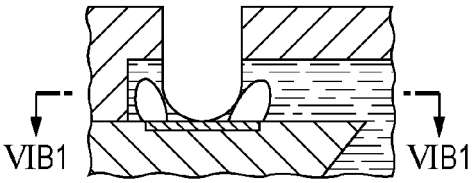
FIG. 6A4
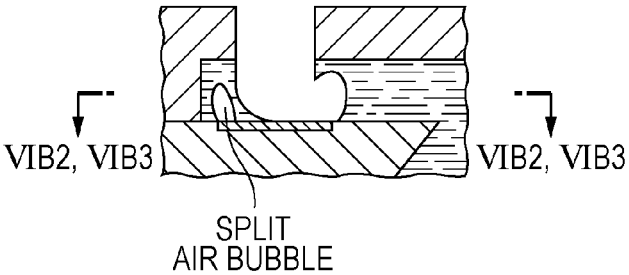
FIG. 6B1
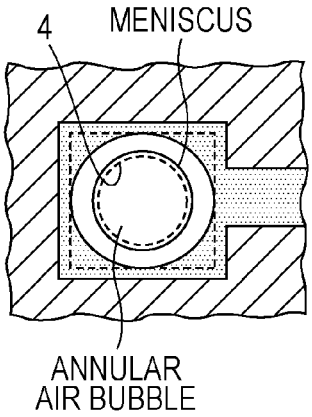
FIG. 6B2
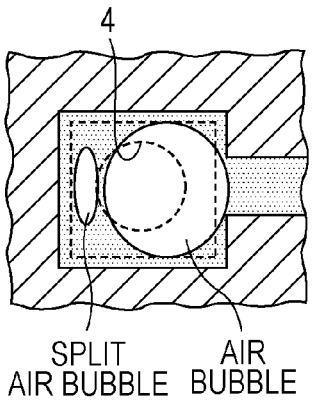
FIG. 6B3
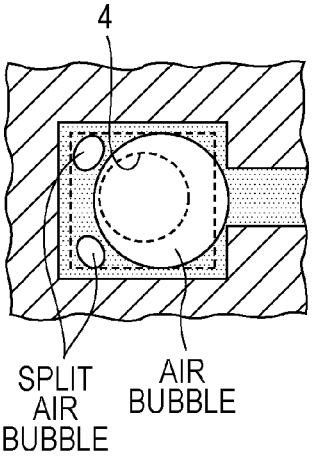

LIQUID DISCHARGING HEAD

BACKGROUND OF THE INVENTION

1. Field of the Invention

The present invention relates to a liquid discharging head configured to perform recording on a recording medium by discharging liquid droplets.

2. Description of the Related Art

One generally-used ink ejection method for a liquid discharging head of an ink jet recording apparatus is a method for discharging ink using an electrothermal conversion element. This method uses film boiling according to thermal energy of the electrothermal conversion element to eject ink within a bubble generating chamber from a discharging port. Ink is discharged as droplets in a direction generally orthogonal to the principal surface of an element substrate. A normal liquid discharging head is formed so that the center positions of the bubble generating chamber, electrothermal conversion element, and discharging port are located in the same position as viewed from a planar view.

When employing this ink discharging method, an air bubble generated by receiving thermal energy on the electrothermal conversion element grows to discharge ink, following which the thermal energy of the electrothermal conversion element and ink existing around the electrothermal conversion element diffuse, whereby the volume of the air bubble is reduced. At the same time, a liquid surface having a meniscus is formed within the discharging port after ink ejection, and this liquid surface descends inside the bubble generating chamber to compress the air bubble. Thus, there may be a case where the air bubble is split to form small split air bubbles, and these split air bubbles damage the surroundings of the air bubble at the time of the split air bubbles collapsing. Specifically, there may be a case where cavitation is generated due to driving of the electrothermal conversion element, and the surface of the electrothermal conversion element is damaged by influence thereof.

A liquid discharging head has been disclosed in Japanese Laid-Open No. 2008-238401 to deal with such cavitation. This liquid discharging head has a configuration wherein the position of the center of the discharging port is disposed on the downstream side from the center of the bubble generating chamber, in the direction of ink flowing into the bubble generating chamber from a supply path (ink flow path). The center of the discharging port is disposed on the downstream side rather than the center of the bubble generating chamber, and accordingly, distance between wall portions on the downstream side of the bubble generating chamber and an inner circumferential edge portion on the downstream side of the discharging port is reduced, and space is reduced. Thus, the air bubble is not readily split by the liquid surface having a meniscus after ink discharge. Accordingly, split air bubbles are not readily formed, and occurrence of cavitation is suppressed. Therefore, the surface of the electrothermal conversion element is not easily damaged, and durability of the liquid discharging head itself is improved.

However, the discharging port of the liquid discharging head is generally formed by patterning by exposure, and accordingly, there are cases where a discharging port is not formed at its predetermined position, due to misalignment at the time of manufacturing. Therefore, even there may be cases even with the configuration of the invention disclosed in Japanese Laid-Open No. 2008-238401 where the position where the discharging port is formed has deviated from the predetermined position, and the center thereof is closer to the center position of the bubble generating chamber. In such a case, as described above, an air bubble may be split by the liquid surface having meniscus after ink ejection, and split air bubbles may be formed. When the split air bubbles are formed, the surface of the electrothermal conversion element is damaged at the time of the split air bubbles collapsing.

SUMMARY OF THE INVENTION

It has been found to be desirable to provide a liquid discharging head including: an element substrate where an energy generating element configured to generate thermal energy is provided onto the principal surface, and a supply port configured to supply liquid is formed; and a flow path forming substrate including a discharging port configured to discharge liquid droplets, a bubble generating chamber communicating with the discharging port and is formed so as to include the energy generating element, and a supply path configured to connect the bubble generating chamber and the supply port, extending along the element substrate. The flow path forming substrate is joined onto the principal surface of the element substrate. The upstream side of the discharging port in the direction of liquid flowing from the supply path to the bubble generating chamber, as viewed from a planar view, is formed in a semicircular shape, and the downstream side is formed in a semi-polygonal shape.

Further features of the present invention will become apparent from the following description of exemplary embodiments with reference to the attached drawings.

BRIEF DESCRIPTION OF THE DRAWINGS

FIGS. 5A1 to 5A4 are cross-sectional views illustrating a process for a liquid surface compressing an air bubble at the liquid discharging head according to the first embodiment, FIG. 5B1 is a cross-sectional view of FIG. 5A3 taken along VB1-VB1, and FIG. 5B2 is a cross-sectional view of FIG. 5A4 taken along VB2-VB2.

FIGS. 6A1 to 6A4 are cross-sectional views illustrating a process for a liquid surface compressing an air bubble at a liquid discharging head according to the related art, FIG. 6B1 is a cross-sectional view of FIG. 6A3 taken along VIB1-VIB1, FIG. 6B2 is a cross-sectional view illustrating an example of FIG. 6A4 taken along VIB2-VIB2, and FIG. 6B3 is a cross-sectional view illustrating an example of FIG. 6A4 taken along VIB3-VIB3.

DESCRIPTION OF THE EMBODIMENTS

Hereinafter, embodiments of the present invention will be described with reference to the drawings.

First Embodiment

Figure 1:
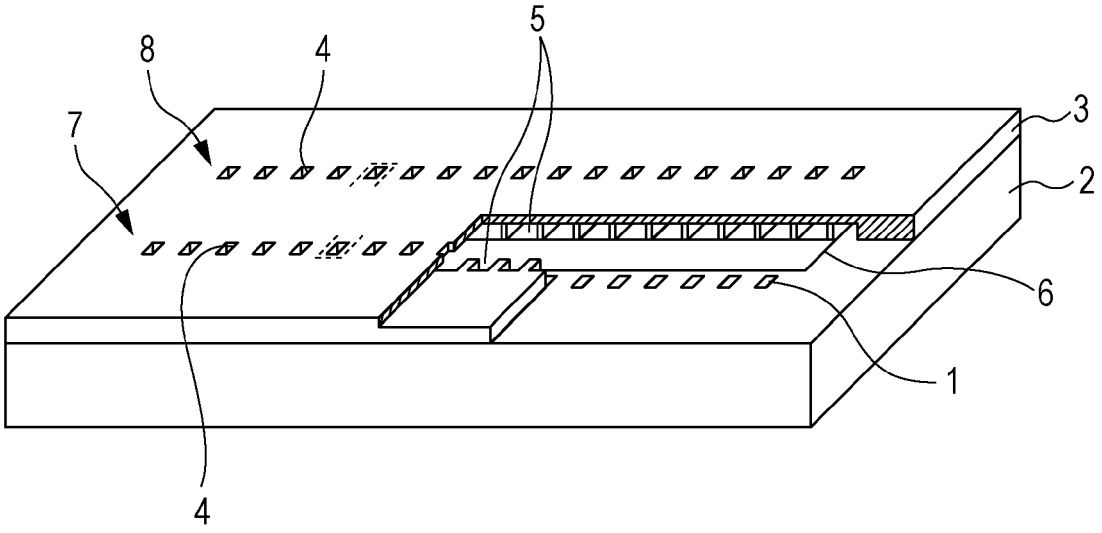
FIG. 1 is a perspective view illustrating a state in which a portion of a liquid discharging head according to an embodiment of the present invention has been cut away.

FIG. 1 is a perspective view illustrating a state in which a portion of a liquid discharging head according to the first embodiment of the present invention has been cut away. The liquid discharging head is configured of a laminate of an element substrate 2, and a flow path forming substrate 3 joined onto the principal surface of the element substrate 2.

The element substrate 2 is formed of glass, ceramics, resin, metal, or the like. A plurality of electrothermal conversion elements (energy generating elements) 1 configured to generate thermal energy are arrayed on the principal surface of the element substrate 2, and the sizes of these electrothermal conversion elements 1 are 24.4 μm×24.8 μm. In addition to these, provided to the principal surface of the element substrate 2 are a supply port 6 configured to supply ink to a later-described supply path 5, an electrode, which is not illustrated, configured to apply voltage to each of the electrothermal conversion elements 1, and wiring, which is not illustrated, connected to the electrode thereof. Further, an insulating film, which is not illustrated, configured to readily diffuse accumulated heat, covers the electrothermal conversion elements 1. A protection film, which is not illustrated, configured to protect the electrothermal conversion elements 1 from cavitation which occurs when a split air bubble dissipates, covers the insulating film.

Figure 2A:
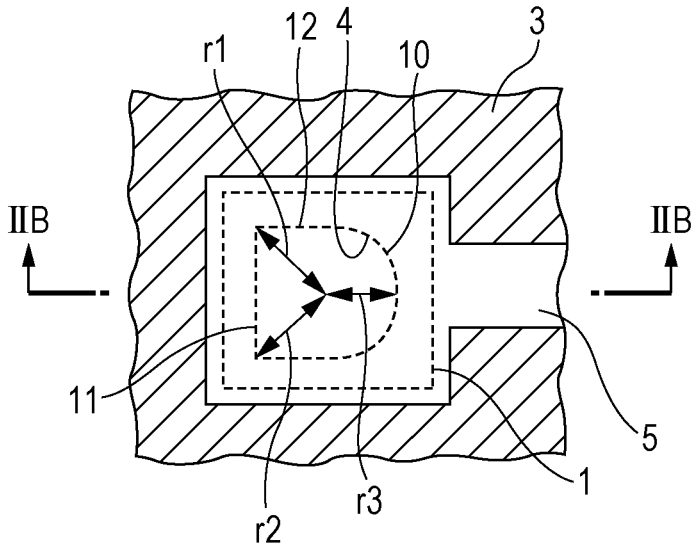
FIG. 2A is a plan view illustrating positional relationship of a discharging port, a bubble generating chamber, an electrothermal conversion element, and a supply path of a liquid discharging head according to a first embodiment of the present invention.
Figure 2B:
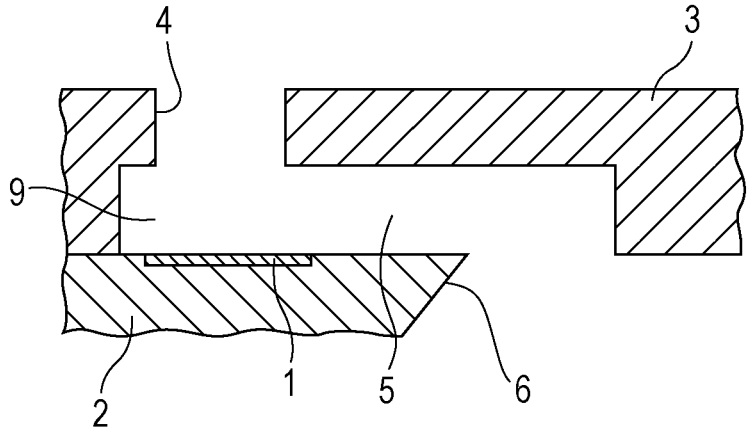
FIG. 2B is a cross-sectional view of FIG. 2A taken along IIB-IIB.

The flow path forming substrate 3 includes, as illustrated in FIG. 2A, a first discharging port row 7 and a second discharging port row 8 which are formed by a plurality of discharging ports 4 configured to discharge liquid such as ink or the like being arrayed, a bubble generating chamber 9 including an electrothermal conversion element 1, and a supply path 5 configured to feed ink to the bubble generating chamber 9. The plurality of the discharging ports 4 each communicate with the bubble generating chambers 9, and are formed so as to be disposed directly above the electrothermal conversion elements 1 provided to the bubble generating chambers 9. The bubble generating chambers 9 are wider than of the supply path 5 as viewed from a planer view, and are formed in a generally rectangular shape. As illustrated in FIGS. 2A and 2B, of the supply path 5, one edge portion communicates with the supply port 6, and the other edge portion communicates with the bubble generating chamber 9. The supply path 5 is formed so as to extend two-dimensionally in a linear shape having a generally equal width from the supply port 6 to the bubble generating chamber 9. The discharging port 4 and supply path 5 are configured so as to intersect at an angle (so as to be orthogonal in the present embodiment).

The discharging port 4 has, as viewed from a planar view, a different shape between the upstream side and downstream side in the direction of ink flowing from the supply port 5 to the bubble generating chamber 9. The upstream side has a semicircular shape 10, and the downstream side has a semi-polygonal shape 11. According to the present embodiment, the semicircular shape 10 of the upstream side is configured as a part of a perfect circle or ellipse. The semi-polygonal shape 11 of the downstream side is a semi-rectangle having two corners, and the angle of each inner angle is 90 degrees, and is similar to a half shape of the bubble generating chamber 9. When the angles thereof exceed 90 degrees, split air bubbles are readily formed, and accordingly, the angle of each inner angle of the semi-polygonal shape 11 is optimally 90 degrees. However, as with a modification illustrated in FIG. 3, the angles are preferably equal to or smaller than 90 degrees, and it has been found that split air bubbles are not readily formed even at 60 degrees, for example. Distances r1 and r2 from the center of the discharging port 4 to the angles of the semi-polygonal shape 11 are formed so as to be longer than distance from the center of the discharging port 4 to an arc portion of the semicircular shape 10, and specifically, distance r3 up to the inner circumferential edge portion farthest upstream.

In the case of forming the discharging port 4 in a circular shape as with the related art, the gap between the inner circumferential edge portion of the discharging port 4 and the wall portion of the bubble generating chamber 9 is widened. In particular, wide space is undesirably formed between the two angles on the downstream side of the generally rectangular bubble generating chamber and the inner circumferential edge portion of the discharging port 4. Therefore, when the liquid surface having meniscus compresses an air bubble after ink ejection, split air bubbles are readily formed in the space between the inner circumferential edge portion of the discharging port 4 and the wall portion of the bubble generating chamber 9.

The discharging port 4 according to the present embodiment is preferably installed so that the center is positioned on the downstream side in the direction of ink flowing from the supply path 5 to the bubble generating chamber 9 rather than the center of the bubble generating chamber 9. The center of the discharging port 4 is thus configured so as to be positioned on the downstream side, whereby distance between the wall portion on the downstream side of the bubble generating chamber 9 and the semi-polygonal shape 11 on the downstream side of the discharging port 4 is reduced. Accordingly, space between the wall portion of the bubble generating chamber 9 and the inner circumferential edge portion of the discharging port 4 is reduced. Consequently, air bubbles are not split when the liquid surface having the meniscus compresses the air bubble, and split air bubbles are not readily formed.

There may be a case where the center of the discharging port 4 is not formed so as to be positioned on the downstream side rather than the center of the bubble generating chamber 9, but formed in the vicinity of the center of the bubble generating chamber 9 due to misalignment at the time of manufacturing the discharging port 4 of the liquid discharging head. In such a case as well, the gap between the wall portion of the bubble generating chamber 9 and the inner circumferential edge portion of the discharging port 4 is does not become great since the downstream side of the discharging port 4 has the semi-polygonal shape 11, and there is no great space sufficient for forming split air bubbles. Accordingly, split air bubbles are not readily formed within the bubble generating chamber 9 after ejection of ink. Thus, even if the discharging port 4 is not formed in a predetermined position due to irregularities of processing precision of the discharging port 4 at the time of manufacturing the liquid discharging head, split air bubbles are not readily formed within the bubble generating chamber 9, and accordingly, the surface of the electrothermal conversion element 1 is not readily damaged by cavitation. As a result, durability of the liquid discharging head itself is improved.

Even if the entire discharging port 4 has a rectangular shape, split air bubbles are not readily formed. However, it has been found that when ink is discharged using a discharging port 4 which has a rectangular shape, the ink is not discharged straight through from the discharging port 4 in a direction perpendicular to the flow path forming substrate 3 but discharged in a direction inclined from the perpendicular direction. Therefore, there is a possibility that visual quality of the formed image may be poor, since the ink may not land at predetermined positions on the recording medium. Accordingly, the shape of the discharging port 4 according to the present embodiment is configured so that the upstream side has the semicircular shape 10, and the downstream side has the semi-polygonal shape 11. In an arrangement where the upstream side has the semicircular shape 10, ink is discharged straight through from the discharging port 4 in a direction perpendicular to the flow path forming substrate 3, and accordingly, the ink lands at predetermined positions on the recording medium, so an image having high appearance quality is formed.

A linear portion 12 is provided to the semi-polygonal shape 11 of the discharging port 4. This linear portion 12 is formed between each corner of the semi-polygonal shape 11 and the boundary of the semicircular shape 10 and semi-polygonal shape 11, and has length of equal to or longer than 4 μm. If the length of the linear portion 12 is shorter than 4 μm, split air bubbles are readily formed after ink is discharged from the discharging port 4 when the liquid surface compresses an air bubble having a meniscus. Therefore, the length of the linear portion 12 is preferably equal to or longer than 4 μm.

Figure 4:
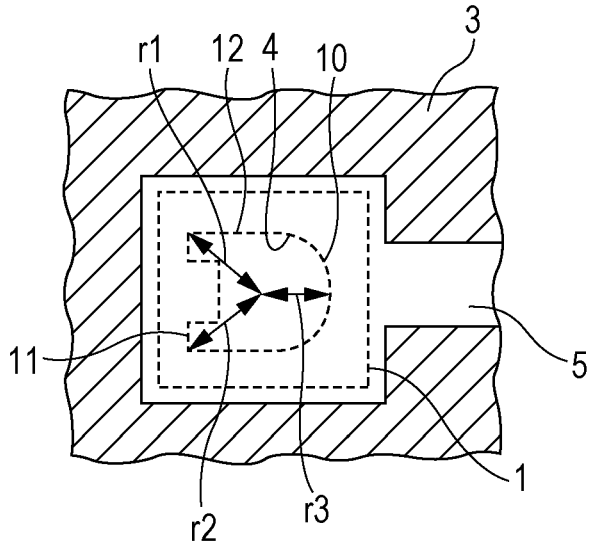
FIG. 4 is a plan view illustrating positional relationship of a discharging port, a bubble generating chamber, an electrothermal conversion element, and a supply path according to a second modification of the liquid discharging head according to the first embodiment.

Also, as illustrated in FIG. 4, a protruding portion 13 protruding from the inner circumferential edge portion to the center portion of the discharging port 4 may be provided between the corners of the semi-polygonal 11 on the downstream side of the discharging port 4. It has been found that split air bubbles are not readily formed by this protruding portion 13 being provided. Also, ink is readily discharged since viscosity resistance within the discharging port 4 is lower, so discharging speed of the ink is faster, and reliability of landing on the recording medium is improved.

Hereinafter, description will be made regarding a process for the liquid surface having a meniscus to compress an air bubble after discharging ink droplets from the discharging port 4 of the liquid discharging head.

In general, according to a method for discharging ink by propagating thermal energy to the ink, when electricity is applied to the electrothermal conversion element 1 in accordance with recording signals or the like received by the liquid discharging head, the electrothermal conversion element 1 generates an air bubble within the bubble generating chamber 9, the volume of the air bubble rapidly expands, and the air bubble itself grows. Next, ink droplets are discharged from the discharging port 4 by bubbling pressure generated by the air bubble being formed. Upon discharge of ink from the discharging port 4 being complete, the volume of the air bubble temporarily reaches is maximum, and thereafter, the volume is reduced. Simultaneously, a liquid surface having a meniscus is formed within the discharging port 4 as illustrated in FIGS. 5A1 and 6A1. The ink within the bubble generating chamber 9 and supply path 5 is reduced by the ink being discharged, and along therewith, the liquid surface having meniscus within the discharging port 4 moves (descends) from the discharging port 4 towards the electrothermal conversion element 1. Upon the descending liquid surface having meniscus entering the bubble generating chamber 9, the edge portion of the descending liquid surface is formed along the inner circumferential edge portion of the discharging port 4. The moving speed of the liquid surface having meniscus at this time is faster than shrinking speed of the air bubble, and accordingly, the liquid surface having the meniscus comes into contact with the shrunk air bubble. A contact position between the liquid surface having meniscus and the air bubble is in the vicinity of the center of the electrothermal conversion element 1 as viewed from a planar view.

The liquid surface having the meniscus, moving from the discharging port 4 to the electrothermal conversion element 1, compresses the ink and air bubble existing between the discharging port 4 and the electrothermal conversion element 1 toward the electrothermal conversion element 1 in the vicinity of the center of the electrothermal conversion element 1. As illustrated in FIGS. 5A2, 5B1, 6A2, and 6B1, upon the air bubble being compressed by the liquid surface having the meniscus, a boundary plane occurs between the air bubble and the liquid surface. Further, compression of the air bubble by the liquid surface progresses, the center of the air bubble becomes indented, and the air bubble instantaneously assumes an annular form as viewed from a planar view. Thereafter, the boundary plane disappears, and the air bubble is communicates with the atmosphere via the discharging port 4.

Figure 3:
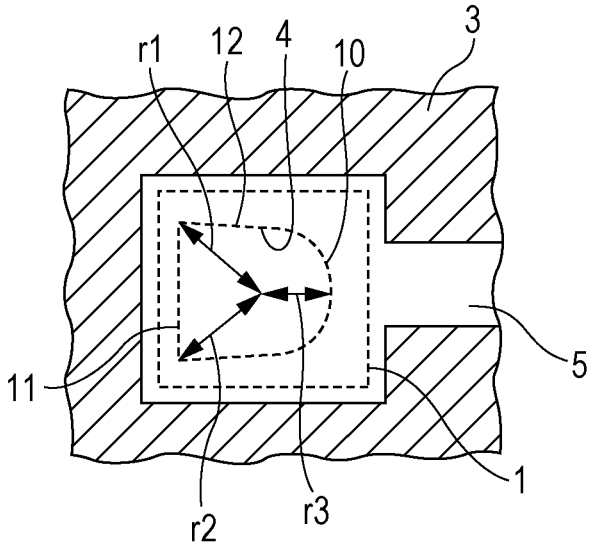
FIG. 3 is a plan view illustrating positional relationship of a discharging port, a bubble generating chamber, an electrothermal conversion element, and a supply path according to a first modification of the liquid discharging head according to the first embodiment.

According to the related art wherein the discharging port 4 is disposed at the center of the electrothermal conversion element 1, as illustrated in FIG. 6A2, the volume of air existing between the boundary plane and the wall portion on the downstream side of the bubble generating chamber 9 increases when the liquid surface having the meniscus compresses the air bubble. Therefore, as illustrated in FIGS. 6B1 and 6B2, after the air bubble instantaneously takes on the annular form, as viewed from a planar view, the air bubble communicates with the atmosphere within the bubble generating chamber 9 and supply path 5, and is also divided into the upstream side and the downstream side in the direction of ink flowing from the supply path 5 to the bubble generating chamber 9. Also, as illustrated in FIG. 6B3, the air bubble communicates with the atmosphere, and is also divided into a part around a corner portion on the downstream side of the bubble generating chamber 9 and a part around the center portion of the bubble generating chamber 9.

The split air bubble split from the air bubble and remaining on the downstream side collapses under pressure of ink when liquid is supplied from the supply port 6 to the bubble generating chamber 9 via the supply path 5, in preparation for the next ink ejection. Upon the spilt air bubble collapsing, the electrothermal conversion elements 1 existing nearby where the split air bubble has collapsed are damaged. Thus, formation and collapse of split air bubbles each time ink is discharged has caused damage to the surface of the electrothermal conversion element 1, and durability of the liquid discharging head according to the related art itself has been poor.

According to an embodiment of the present invention, the downstream side of the discharging port 4 has the semi-polygonal shape 11, and the position of the center of the discharging port 4 is positioned on the downstream side rather than at the center of the bubble generating chamber 9. Accordingly, the distance between the inner circumferential edge portion of the semi-polygonal shape 11 on the downstream side of the discharging port 4 and the wall portion of the bubble generating chamber 9 is short. Thus, space between the wall portion of the bubble generating chamber 9 and the inner circumferential edge portion of the discharging port 4 is reduced, and the volume of air existing between the boundary plane and the wall portion on the downstream side of the bubble generating chamber 9 is reduced. Therefore, as illustrated in FIGS. 5B1 and 5B2, after the air bubble takes on annular form in planar view, the air bubble is not split within the bubble generating chamber 9. Accordingly, split air bubbles are not readily formed within the bubble generating chamber 9, and even when liquid is supplied from the supply port 6 to the bubble generating chamber 9 via the supply path 5 in preparation for the next ink ejection, there is no split air bubble collapsing. Accordingly, the surface of the electrothermal conversion element 1 is not readily damaged. As a result, durability of the liquid discharging head itself is improved.

As described above, the upstream side of the discharging port 4 of the liquid discharging head is configured in the semicircular shape 10, and the downstream side is configured in the semi-polygonal shape 11, so cavitation does not readily occur even when ink is repeatedly discharged, and damage of the surface of the electrothermal conversion element 1 is suppressed. Also, even when the position of the center of the discharging port 4 is positioned on the downstream side rather than at the center of the bubble generating chamber 9, the distance between the inner circumferential edge portion of the semi-polygonal shape 11 on the downstream side of the discharging port 4 and the wall portion of the bubble generating chamber 9 is reduced, and accordingly, occurrence of cavitation is further suppressed. Even if the position of the discharging port 4 happens to be formed shifted toward the communicating portion side between the bubble generating chamber 9 and the supply path 5 due to irregularities in processing precision at the time of manufacturing the liquid discharging head, the gap between the wall portion of the bubble generating chamber 9 and the inner circumferential edge portion of the discharging port is not great, due to the downstream side of the discharging port 4 having the semi-polygonal shape 11. Thus, there is no space sufficient for forming a split air bubble between the wall portion of the bubble generating chamber 9 and the inner circumferential edge portion of the discharging port 4, and accordingly, split air bubbles are not readily formed within the bubble generating chamber 9 after discharging ink, and the surface of the electrothermal conversion element 1 is not readily damaged.

Thus, the liquid discharging head is configured so as to have durability sufficient for preventing damage even when repeatedly discharging ink.

Second Embodiment

A liquid discharging head according to a second embodiment of the present invention is also configured of, as illustrated in FIG. 1, a laminate of an element substrate 2 including a plurality of electrothermal conversion elements 1, and a flow path forming substrate 3 joined onto the principal surface of the element substrate 2 and having a first discharging port row 7 and a second discharging port row 8.

Figure 7A:
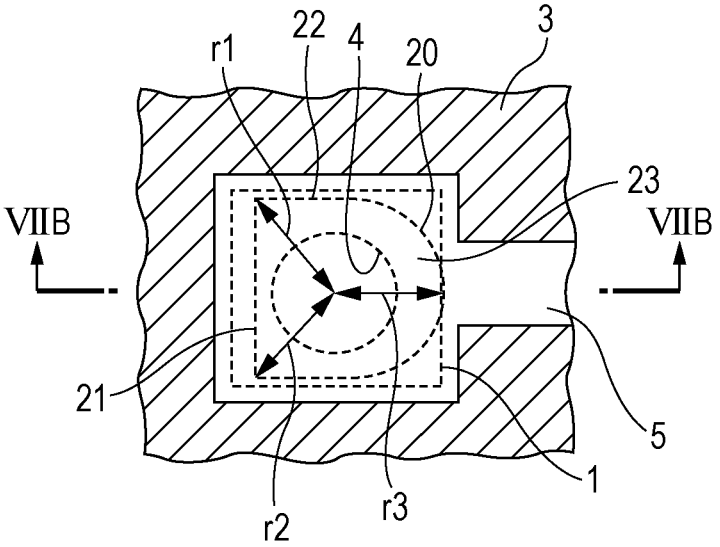
FIG. 7A is a plan view illustrating positional relationship of a discharging port, a discharge flow path, a bubble generating chamber, an electrothermal conversion element, and a supply path of a liquid discharging head according to a second embodiment of the present invention.
Figure 7B:
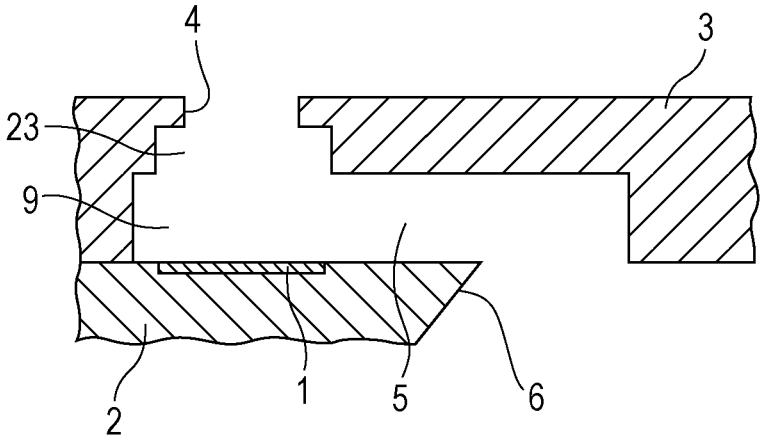
FIG. 7B is a cross-sectional view of FIG. 7A taken along VIIB-VIIB.

FIGS. 7A and 7B are a plan view and a cross-sectional view illustrating positional relationship of each of the discharging port 4, discharging flow path 23, bubble generating chamber 9, electrothermal conversion elements 1, and supply path 5 in the liquid discharging head, according to the second embodiment.

The flow path forming substrate 3 includes the discharging port 4 configured to discharge ink, the bubble generating chamber 9 including the electrothermal conversion element 1, a discharging flow path 23 provided between the discharging port 4 and the bubble generating chamber 9, and the supply path 5 configured to flow into to the bubble generating chamber 9. The discharging flow path 23 means space for supplying ink from the bubble generating chamber 9 to the discharging port 4. This discharging flow path 23 is wider than the discharging port 4 and extends from the discharging port 4 to the bubble generating chamber 9. The discharging port 4 communicates with the bubble generating chamber 9 via the discharging flow path 23, and is formed in a circular shape so as to be positioned directly above the electrothermal conversion element 1 provided to the bubble generating chamber 9. The bubble generating chamber 9 is, as viewed from a planar view, wider than the supply path 5, and is formed in a generally rectangular shape. The supply path 5 is configured so that one edge portion of the supply path 5 communicates with the supply port 6, and the other edge portion communicates with the bubble generating chamber 9. The supply path 5 is formed so as to have a straight line shape of which the width is generally equal from the supply port 6 to the bubble generating chamber 9 and so as to extend two-dimensionally. The discharging port 4 and discharging flow path 23 are configured so as to intersect the supply path 5 at an angle (so as to be orthogonal to the supply path 5 in the present embodiment).

Figure 8:
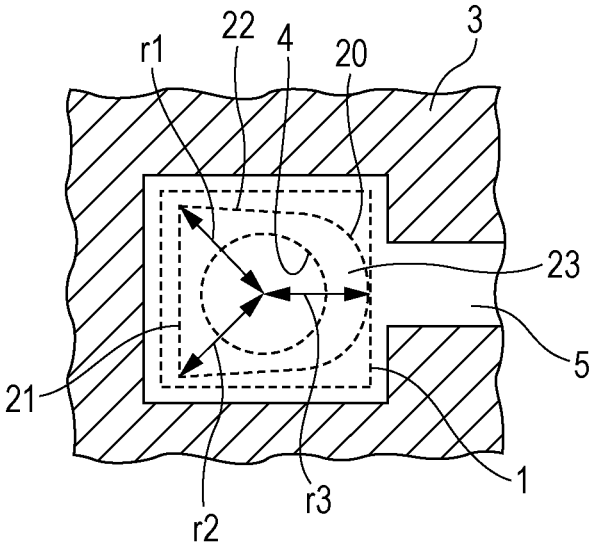
FIG. 8 is a plan view illustrating positional relationship of a discharging port, a bubble generating chamber, an electrothermal conversion element, and a supply path according to a first modification of the liquid discharging head according to the second embodiment.

The discharging flow path 23 has, as viewed from a planar view, a different shape between the upstream side and downstream side in the direction of ink flowing from the supply path 5 to the bubble generating chamber 9. The upstream side has a semicircular shape 20, and the downstream side has a semi-polygonal shape 21. According to the present embodiment, the semicircular shape 20 of the upstream side is configured of a part of a perfect circle or ellipse. The semi-polygonal shape 21 of the downstream side is a semi-rectangle having two corners, the angle of each inner angle is 90 degrees, and the shape is similar to a half shape of the bubble generating chamber 9. When the angles thereof exceed 90 degrees, split air bubbles are readily formed, and accordingly, the angle of each inner angle of the semi-polygonal shape 21 is optimally 90 degrees. However, as with a modification illustrated in FIG. 8, the angles are preferably an angle not exceeding 90 degrees, and it has been found that split air bubbles are not readily formed even at 60 degrees, for example. Distances r1 and r2 from the center of the discharging flow path 23 to the angles of the semi-polygonal shape 21 are formed so as to be longer than distance r3 from the center of the discharging flow path 23 to the inner circumferential edge portion of the most upstream of the semicircular shape 20.

A linear portion 22 is provided to the semi-polygonal shape 21 of the discharging flow path 23. This linear portion 22 is formed between each corner of the semi-polygonal shape 21 and a boundary of the semicircular shape 20 and semi-polygonal shape 21. The length is equal to or longer than 4 μm.

Figure 9:
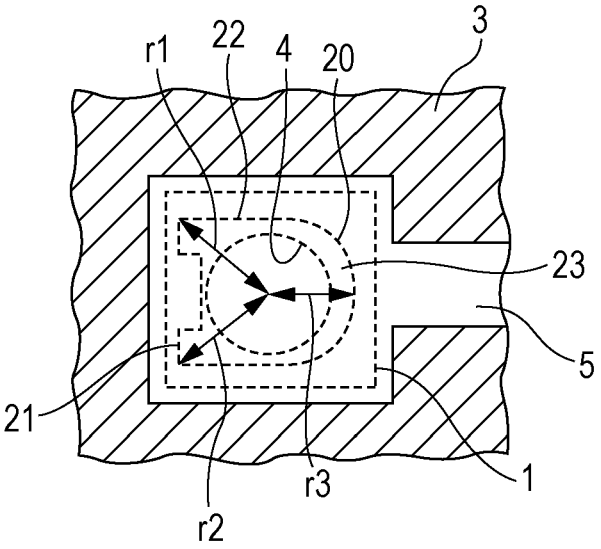
FIG. 9 is a plan view illustrating positional relationship of a discharging port, a bubble generating chamber, an electrothermal conversion element, and a supply path according to a second modification of the liquid discharging head according to the second embodiment.

Also, as illustrated in FIG. 9, the discharging flow path 23 may include a protruding portion 24 protruding toward the center from the inner circumferential edge portion of the discharging flow path 23, between the corners of the semi-polygonal 21 on the downstream side of the discharging flow path 23. It has been found that split air bubbles are not readily formed due to this protruding portion 24 being provided. Also, ink is readily discharged since viscosity resistance within the discharging flow path 23 is lower, and accordingly, the discharging speed of ink is faster, and reliability of landing on the recording medium is improved.

Other configurations are the same as with the first embodiment, and accordingly, description will be omitted. Also, a process for the liquid surface having meniscus compressing an air bubble after discharging ink droplets from the discharging port 4 of the liquid discharging head is also the same as with the first embodiment, and accordingly, description will be omitted.

As described above, the upstream side of the discharging flow path 23 of the liquid discharging head is configured of the semicircular shape 20, and the downstream side is configured of the semi-polygonal shape 21, whereby distance between the inner circumferential edge portion of the semi-polygonal shape 21 on the downstream side of the discharging flow path 23 and the wall portion of the bubble generating chamber 9 is reduced. Thus, there is no space sufficient for forming a split air bubble between the wall portion of the bubble generating chamber 9 and the inner circumferential edge portion of the discharging port 4. Accordingly, split air bubbles are not readily formed within the bubble generating chamber 9 after discharging ink. Split air bubbles are not readily formed, and accordingly, cavitation does not readily occur even when the discharging port 4 repeatedly discharges ink, so damage of the surface of the electrothermal conversion element 1 is suppressed.

Thus, the liquid discharging head is configured so as to have durability sufficient for preventing damage even when repeatedly discharging ink.

According to the present invention, the downstream side of a discharging port, in the direction of liquid flowing from a supply path to a bubble generating chamber, is formed in a semi-polygonal shape, and accordingly, the distance between the wall portion of the bubble generating chamber and the inner circumferential edge portion in a semi-polygonal shape on the downstream side of the discharging port is reduced as viewed from a planar view. This reduction in distance means that when the liquid surface having the meniscus compresses an air bubble after discharging ink, there is no space sufficient for forming split air bubbles between the wall portion of the bubble generating chamber and the inner circumferential edge portion of the discharging port. Accordingly, split air bubbles are not readily formed after discharging ink. Occurrence of cavitation is suppressed since split air bubbles are not readily formed, and accordingly, the surface of the electrothermal conversion element is not readily damaged. Consequently, durability of the liquid discharging head itself is improved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-285433, filed Dec. 27, 2012, which is hereby incorporated by reference herein in its entirety.

What is claimed is:

1. A liquid discharging head comprising:

an element substrate, including an energy generating element configured to generate thermal energy, provided onto a surface of the element substrate, and a supply port configured to supply liquid, formed in the element substrate; and a flow path forming substrate joined with the element substrate, including a circular discharging port configured to discharge liquid droplets, a bubble generating chamber communicating with the circular discharging port and formed so as to include the energy generating element, a discharge flow path configured to connect the circular discharging port and the bubble generating chamber, and a supply path configured to connect the bubble generating chamber and the supply port, extending along the element substrate, wherein the discharge flow path has, as viewed from a direction orthogonal to the flow path forming substrate, a shape greater in surface area than the circular discharging port but smaller in surface area than the bubble generating chamber, of which an upstream side in a direction of liquid flowing from the supply path to the bubble generating chamber is formed in a semicircular shape, and a downstream side is formed in a semi-polygonal shape, and wherein, as viewed from a direction orthogonal to the flow path forming substrate, a distance from a center of the circular discharging port to a farthest corner of the semi-polygonal shape is longer than a distance from the center of the circular discharging port to a farthest arc portion of the semicircular shape.

2. The liquid discharging head according to claim 1, wherein a center, as determined based on a geometric shape of the discharge flow path is positioned, in planar view, on the downstream side in a direction of liquid flowing from the supply path toward the bubble generating chamber, rather than at a center, as determined based on a geometric shape of the bubble generating chamber.

3. The liquid discharging head according to claim 1, wherein the semi-polygonal shape is similar to a half shape of the bubble generating chamber.

4. The liquid discharging head according to claim 1, wherein the angle of each inner angle that the semi-polygonal shape has is equal to or smaller than 90 degrees.

5. The liquid discharging head according to claim 1, wherein the semi-polygonal shape of the downstream side of the circular discharging port has a linear portion equal to or longer than predetermined length between each corner and a boundary of the semi-polygonal shape and the semicircular shape of the circular discharging port.

6. The liquid discharging head according to claim 5, wherein length of the linear portion is equal to or longer than 4 μm.

* * * * *